US010995942B2

(12) United States Patent
Ma et al.

(10) Patent No.: US 10,995,942 B2
(45) Date of Patent: May 4, 2021

(54) INSTALLATION BOTTOM BASE, CONNECTION BASE, LIGHT SOURCE MODULE AND LIGHTING DEVICE

(71) Applicant: OPPLE LIGHTING CO., LTD., Shanghai (CN)

(72) Inventors: Zicai Ma, Shanghai (CN); Chaoguang Li, Shanghai (CN); Xuejun Feng, Shanghai (CN); Chengxiang Li, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 190 days.

(21) Appl. No.: 16/378,026

(22) Filed: Apr. 8, 2019

(65) Prior Publication Data

US 2019/0234598 A1 Aug. 1, 2019

Related U.S. Application Data

(63) Continuation of application No. PCT/CN2017/105740, filed on Oct. 11, 2017.

(30) Foreign Application Priority Data

Oct. 11, 2016 (CN) ..... 201610887676.6
Oct. 11, 2016 (CN) ..... 201610888865.5
(Continued)

(51) Int. Cl.
*F21V 23/00* (2015.01)
*F21V 19/00* (2006.01)
(Continued)

(52) U.S. Cl.
CPC ..... *F21V 23/004* (2013.01); *F21K 9/20* (2016.08); *F21V 19/004* (2013.01);
(Continued)

(58) Field of Classification Search
CPC .... F21V 23/001; F21V 23/004; F21V 23/006; F21V 23/06; F21V 19/004; F21K 9/20; H05B 47/00
See application file for complete search history.

(56) References Cited

U.S. PATENT DOCUMENTS

2014/0286021 A1* 9/2014 Kimiya ..... F21V 29/71 362/373

FOREIGN PATENT DOCUMENTS

CN 202048468 U 11/2011
CN 102510973 A 6/2012
(Continued)

OTHER PUBLICATIONS

Internationial Search Report (including English translation) and Written Opinion issued in PCT/CN2017/105740, dated Jan. 18, 2018, 14 pages.

*Primary Examiner* — Thomas M Sember
(74) *Attorney, Agent, or Firm* — Arch & Lake LLP

(57) ABSTRACT

An installation bottom base is provided. The installation bottom base includes: a main body, a fixed installation structure connected with the main body, a light source installation structure and a bottom base terminal assembly, and the bottom base terminal assembly includes at least two bottom base terminals exposed to the light source installation structure. When the light source module is installed to the bottom base, the at least two base terminals are electrically connected with the plurality of light emitting units in the light source module, so that at least two of the light emitting units in the light source module are in different power supply circuits. In summary, current supplied to the light emitting units by a power module is transmitted by the at least two terminals, so that the at least two light emitting units are in different power supply circuits.

17 Claims, 12 Drawing Sheets

(30) Foreign Application Priority Data

Oct. 11, 2016 (CN) ..... 201621113757.2
Oct. 11, 2016 (CN) ..... 201621115136.8

(51) Int. Cl.

| | |
|---|---|
| ***F21V 23/06*** | (2006.01) |
| ***F21K 9/20*** | (2016.01) |
| ***H05B 47/00*** | (2020.01) |
| *F21Y 113/13* | (2016.01) |
| *F21Y 115/10* | (2016.01) |
| *F21Y 107/00* | (2016.01) |

(52) U.S. Cl.

CPC ..... *F21V 23/001* (2013.01); *F21V 23/006* (2013.01); *F21V 23/06* (2013.01); *H05B 47/00* (2020.01); *F21Y 2107/00* (2016.08); *F21Y 2113/13* (2016.08); *F21Y 2115/10* (2016.08)

(56) References Cited

FOREIGN PATENT DOCUMENTS

| | | | |
|---|---|---|---|
| CN | 202385348 | U | 8/2012 |
| CN | 202432376 | U | 9/2012 |
| CN | 203322816 | U | 12/2013 |
| CN | 104061462 | A | 9/2014 |
| CN | 104838496 | A | 8/2015 |
| CN | 105179982 | A | 12/2015 |
| CN | 106287442 | A | 1/2017 |
| CN | 106287443 | A | 1/2017 |
| CN | 206072892 | U | 4/2017 |
| CN | 206072893 | U | 4/2017 |
| JP | 2009283229 | A | 12/2009 |

* cited by examiner

INSTALLATION BOTTOM BASE, CONNECTION BASE, LIGHT SOURCE MODULE AND LIGHTING DEVICE

CROSS-REFERENCE TO RELATED APPLICATIONS

The application is based upon and claims the priority of PCT patent application No. PCT/CN2017/105740 filed on Oct. 11, 2017 which claims the priority of Chinese Patent Application No. 201610888865.5 filed on Oct. 11, 2016, Chinese Patent Application No. 201610887676.6 filed on Oct. 11, 2016, Chinese Patent Application No. 201621115136.8 filed on Oct. 11, 2016, and Chinese Patent Application No. 201621113757.2 filed on Oct. 11, 2016, the entire content of all of which is hereby incorporated by reference herein for all purposes.

TECHNICAL FIELD

The present disclosure relates to a lighting technical field, particularly to an installation bottom base, a connection base, a light source module, and a lighting device.

BACKGROUND

With the rapid development of lighting technology, lighting technology is no longer limited to illuminating objects, but upgraded to a technology that can adjust colors of light emitted by a lighting device according to a lighting scene or user needs, so that the lighting device adopting the lighting technology is applied more widely.

A current lighting device generally includes a light source module consisting of a plurality of light emitting units and a power module supplying power to the light source module. Both the power module and the light source module have only two terminals, that is, a positive terminal and a negative terminal. The power module and the light source module are electrically connected by a matching connection of the two terminals respectively thereof.

The light emitting units in the light source module have preset colors. By supplying power to the light emitting units through the power module, light emitted by the lighting device has corresponding colors. However, in the current lighting device, because only one power supply circuit is provided between the power module and the light source module, when an output current of the power module changes, currents received by all the light emitting units in the light source module are adjusted together with a same magnitude, as a result, it is difficult to adjust the color of the light emitted by the current lighting device, which makes the lighting device unable to adapt to the increasingly diverse lighting needs.

In addition, when assembling the lighting device, first, it is required to align the terminal in the light source module and the terminal in the power module and then drive the light source module to move towards the power module to correspondingly connect the terminal of the light source module and the terminal of the power module, so that power output from the power module is transferred to the light source module; subsequently, the light emitted by lighting device can be adjusted by adjusting the power supplied by the power module to the light source module. However, in an assembly process of the current lighting device, it is required that the terminal in the power module is aligned with the terminal in the light source module, and the alignment process tests a user's eyesight and skills, which results in a high difficulty of the assembling the current lighting device and affects the user's experience.

SUMMARY

An objective of embodiments of the present disclosure is to provides an installation bottom base, a connection base, a light source module and a lighting device, which are used to solve a problem that a current lighting device can only adjust currents of all light emitting units at the same time and it is difficult to adjust a color of light emitted by the lighting device.

In a first aspect, the present disclosure provides an installation bottom base for installing a light source module in a lighting device. The light source module comprises a plurality of light emitting units, characterized in that the installation bottom base comprises: a main body; a fixed installation structure connected with the main body and used for installing the installation bottom base to a preset region; a light source installation structure connected with the main body and used for installing the light source module; and a bottom base terminal assembly comprising at least two bottom base terminals exposed to the light source installation structure. When the light source module is installed to the installation bottom base, the at least two bottom base terminals are electrically connected with the plurality of light emitting units in the light source module, to allow at least two of the light emitting units in the light source module to be in different power supply circuits.

In a second aspect, the present disclosure provide a connection base for installing a light emitting assembly in a light source module. The light emitting assembly comprises a plurality of light emitting units. The connection base comprises: a base portion; an assembly installation structure connected with the base portion and used for installing the light emitting assembly; and a base terminal assembly comprising at least two base terminals extending to the assembly installation structure. When the light emitting assembly is installed to the connection base, the at least two base terminals are electrically connected with the plurality of light emitting units in the light emitting assembly, to allow at least two of the light emitting units in the light emitting assembly to be in different power supply circuits.

BRIEF DESCRIPTION OF THE DRAWINGS

In order to clearly illustrate the technical solutions of the embodiments of the disclosure or the prior art, the drawings of the embodiments or the prior art will be briefly described in the following description. It is apparent that the described drawings are only related to some embodiments of the disclosure, and for one of ordinary skill in the art, other drawings can also be obtained according to these drawings without any creative labor.

DETAILED DESCRIPTION

Embodiments of the present disclosure provide an installation bottom base, a connection base, a light source module and a lighting device, which are used to solve a problem that the current lighting device can only adjust currents of all light emitting units at the same time so that it is difficult to adjust a color of light emitted by the lighting device and a problem of a high difficulty of assembling the current lighting device.

In order to allow one of ordinary skill in the art to understand technical solutions of the present disclosure better, the technical solutions of the embodiments of the present disclosure will be described in a clearly and fully understandable way in connection with the drawings related to the embodiments of the disclosure. Apparently, the described embodiments are just a part but not all of the embodiments of the disclosure. Based on the described embodiments herein, one or ordinary skill in the art can obtain other embodiment (s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Figure 1:
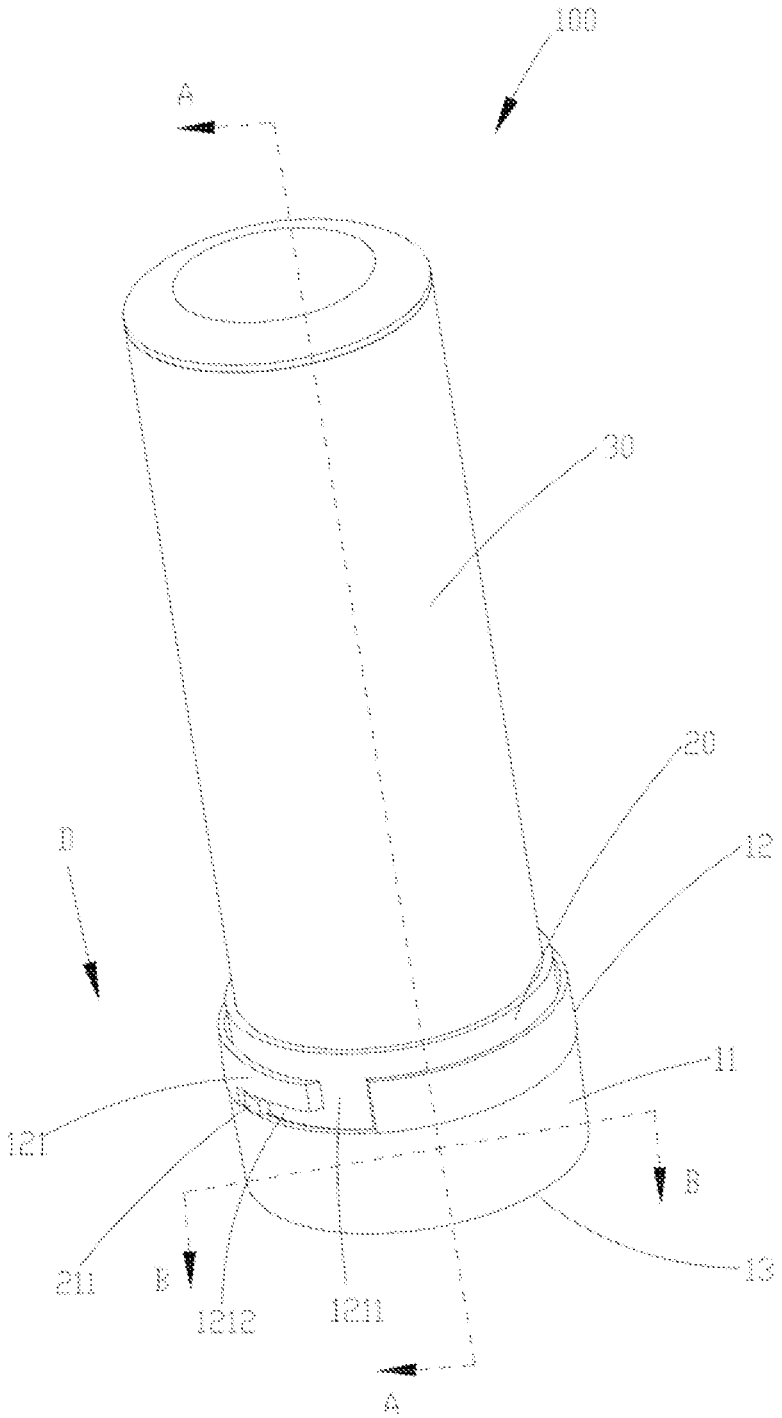
FIG. 1 is a stereo diagram of a lighting device in an example of the present disclosure.
Figure 2:
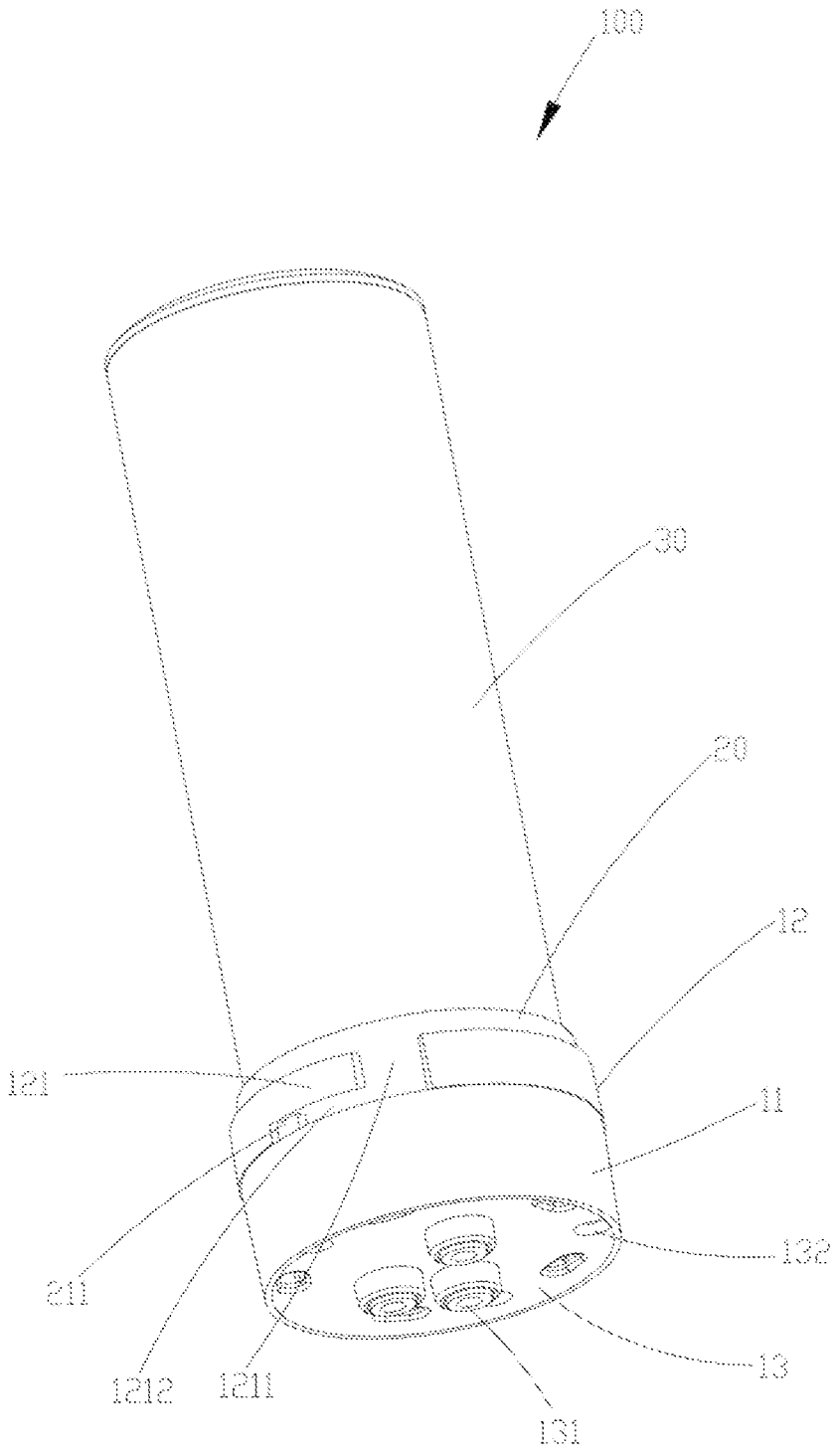
FIG. 2 is a stereo diagram at another angle of the lighting device shown in FIG. 1.
Figure 3:
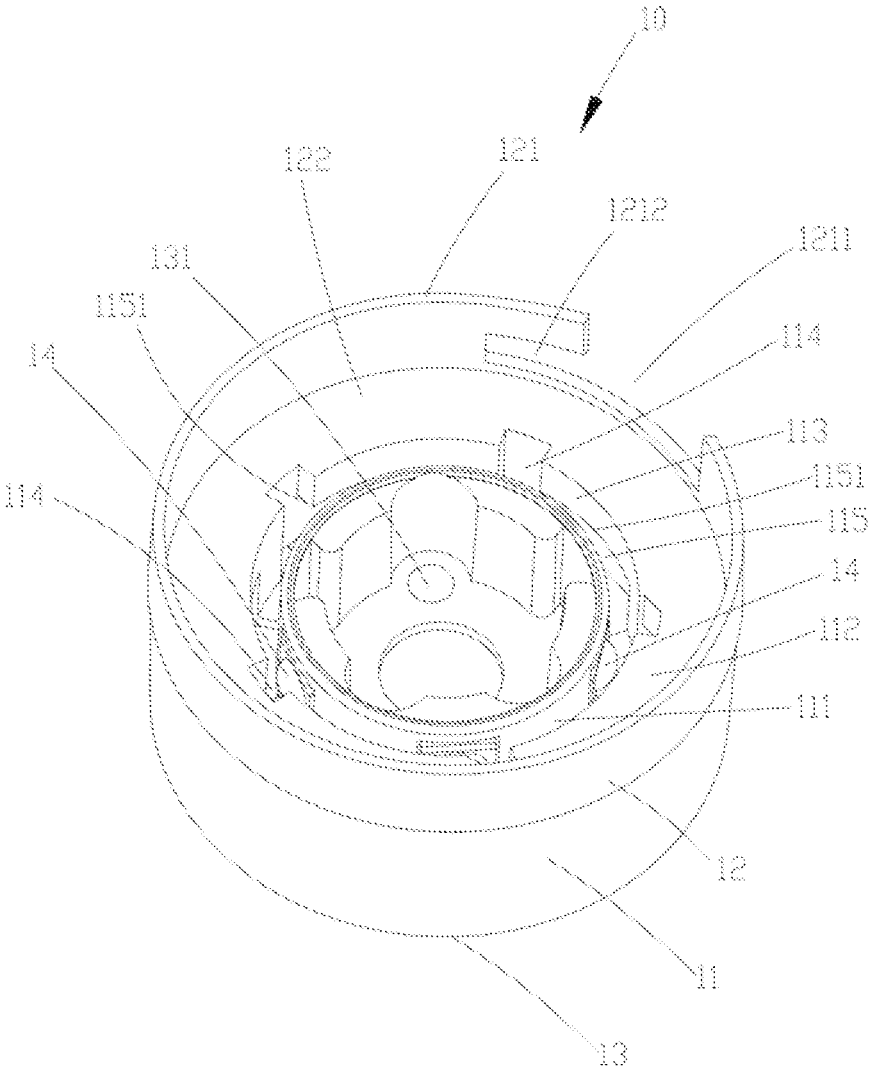
FIG. 3 is a stereo diagram of an installation bottom base in the lighting device shown in FIG. 1.

Referring to FIG. 1, FIG. 2 and FIG. 3, a lighting device 100 comprises an installation bottom base 10, a connection base 20 installed to the installation bottom base 10 and a light emitting assembly 30 installed to the connection base 20. The connection base 20 can cooperate with the light emitting assembly 30 to form a light source module (not labeled) to be used independently.

In one or more examples, the lighting device 100 can be a common type of a plug-in and pull-out lamp, a tube lamp, a ceiling lamp, etc. The lighting device 100 can be installed to a ceiling, a wall or other positions. A power module used in the lighting device 100 can be a power, such as an alternating current power of commercial power or a direct current power of a battery pack, or the power module can even be an input power based on a conversion from the commercial power, for example, a low-voltage power, such as 60V.

Of course, in some scenes, the power module can also include functional units of conventional over-current protection, over-discharge protection, voltage adapter and current adapter etc. to protect a normal operation of the lighting device 100. Of course, the functional units can be directly built-in the light source module, as long as the functional units are electrically connected with the power module and the light emitting assembly, this technology is well known to one of ordinary skill in the art and no detail is repeated herein.

In an embodiment of the present disclosure, the lighting device 100 is installed to a preset region, such as a ceiling, a wall, etc. by the installation bottom base 10, and the lighting device 100 can even be installed in a lamp body of, for example, a desk lamp, a flower lamp, a decorative lamp or a pendant lamp as a detachable assembly, and is electrically connected with the power module (not shown) by the installation bottom base 10, so that an output power of the power module is transmitted to the light emitting assembly 30 by the connection base 20, so that lighting device 100 is lightened.

Specifically, the installation bottom base 10 comprises a main body 11, a light source installation structure 12 connected with the main body 11 and a fixed installation structure 13.

A shape of the main body 11 can be designed according to an overall shape of the lighting device 100 or an illumination environment, for example, a barrel-like shape. The main body 11 can be made of insulating materials, such as hard plastics, to ensure a structural stability and safety of the installation bottom base 10.

The light source installation structure 12 is used for installing the light source module. Specifically, the light source installation structure 12 is used for installing the connection base 20 in the light source module.

In conjunction with FIG. 3, the light source installation structure 12 can adopt a form of an insertion interface, and specifically, the light source mounting unit 12 adopts a form of a female connector. In this case, the light source installation structure 12 includes an enclosed ring-shaped matching outer wall 121 and a matching outer cavity 122 formed by the matching outer wall 121 arranged annularly, and the connection base 20 is inserted into the matching outer cavity 122 along a preset insertion direction D (as shown in FIG. 1) and is detachably locked with the matching outer wall 121, to allow the connection base 20 to be installed to the installation bottom base 10.

In an embodiment of the present disclosure, the matching outer wall 121 is provided with a guide notch 1211 and a clamping notch 1212, the guide notch 1211 extends along the preset insertion direction D of the light source module inserting into the matching outer cavity 122, and the clamping notch 1212 is connected with the guide notch 1211.

In one or more examples, the clamping notch 1212 extends from the guide notch 1211 along a circumferential direction of the matching outer wall 121. A size of the guide notch 1211 and a size of the clamping notch 1212 can be determined according to actual requirements, no detail is repeated herein.

The main body 11 further comprises a matching inner cavity 111 communicated with the matching outer cavity 122, a width of the matching inner cavity 111 is less than a width of the matching outer cavity 122, and the matching inner cavity 111 is in the preset insertion direction D of the matching outer cavity 122, so that the connection base 20 is inserted successively in the matching outer cavity 122 and the matching inner cavity 111, so that the light source module is inserted successively in the matching outer cavity 122 and the matching inner cavity 111 to match and connect the installation bottom base 10.

It should be noted that the width of the matching inner cavity 111 is less than the width of the matching outer cavity 122, which represents that, along the preset insertion direction D, a cross-section size of the matching inner cavity 111 is less than that of the matching outer cavity 122. In an embodiment of the present disclosure, the matching outer cavity 122 is approximately in a cylindrical shape, the matching inner cavity 111 is approximately in a shape of a circular ring, and the matching inner cavity 111 is basically in a central region of the matching outer cavity 122.

In one or more examples, the main body 11 comprises a blocking wall 112 of a bottom wall forming the matching outer cavity 122, and the matching inner cavity 111 is opened on the blocking wall 112 along the preset insertion direction D, so that the matching inner cavity 111 and the matching outer cavity 122 are arranged and extend along the preset insertion direction D and are communicated with each other, meanwhile, the width of the matching inner cavity 111 is less than the width of the matching outer cavity 122.

The main body 11 comprises a matching inner wall 113 forming the outer wall surface of the matching inner cavity 111. As the matching inner cavity 111 is arranged in a shape of a circular ring, the matching inner wall 113 is used to describe the outer surface, away from a center of the circular ring, of the circular matching inner cavity 111. Matching with the shape of the matching inner cavity 111, the matching inner wall 113 is embodied as a wall surface in a shape of a circular ring extending around the preset direction D.

In an embodiment of the present disclosure, the main body 11 comprises a fool-proof notch 114 formed on the matching inner wall 113, and the fool-proof notch 114 extends along the preset insertion direction D and is communicated with the matching inner cavity 111. In one or more examples, the fool-proof notch 114 can be arranged at the interface of the blocking wall 112 and the matching inner wall 113, so that the fool-proof notch 114 is communicated with both the matching outer cavity 122 and the matching inner cavity 111.

The main body 11 further comprises a position limiting groove 115 on the matching inner wall 113, and the position limiting groove 115 is communicated with the fool-proof notch 114. In one or more examples, the matching inner wall 113 is arranged in a shape of a ring, the position limiting groove 115 can extend from the fool-proof notch 114 along a circumferential direction of the matching inner wall 113, so that the position limiting groove 115 is perpendicular to the fool-proof notch 114.

Figure 4:
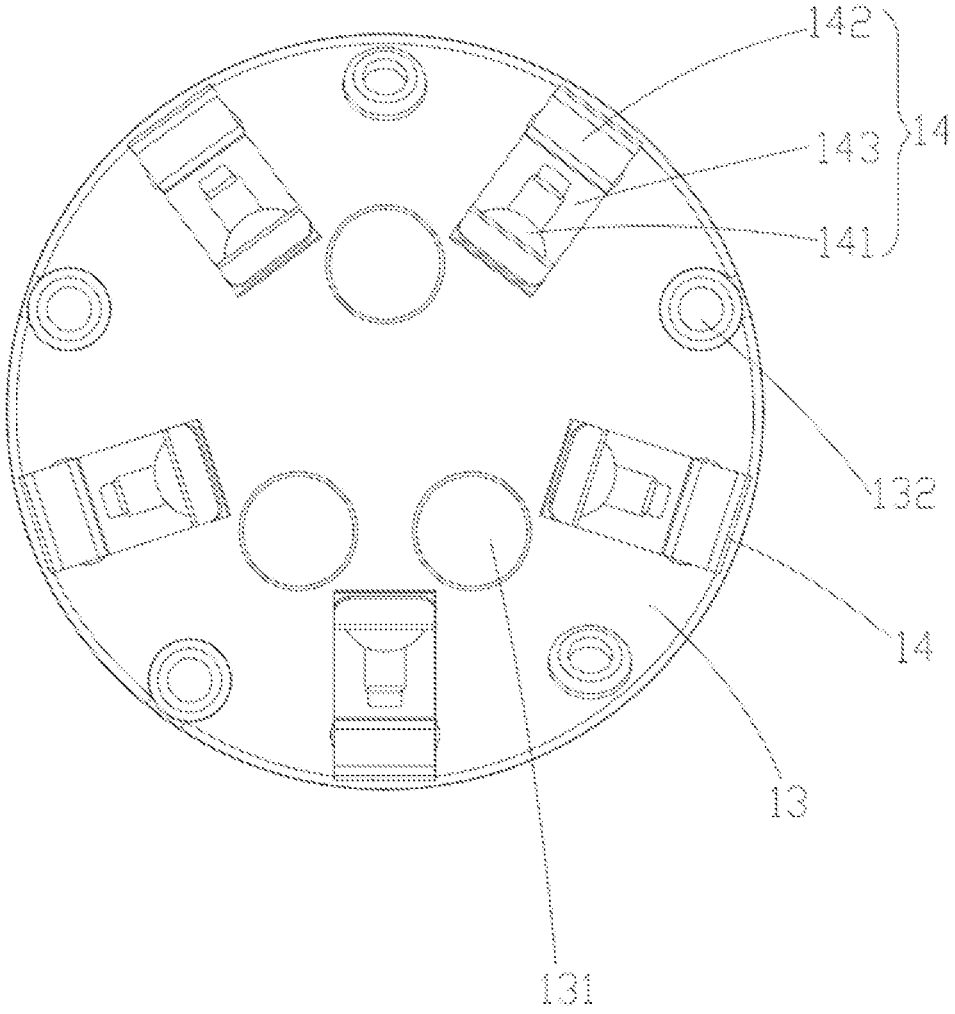
FIG. 4 is a top view of the installation bottom base shown in FIG. 3, in which the main body and the light source installation structure are both hidden.
Figure 5:
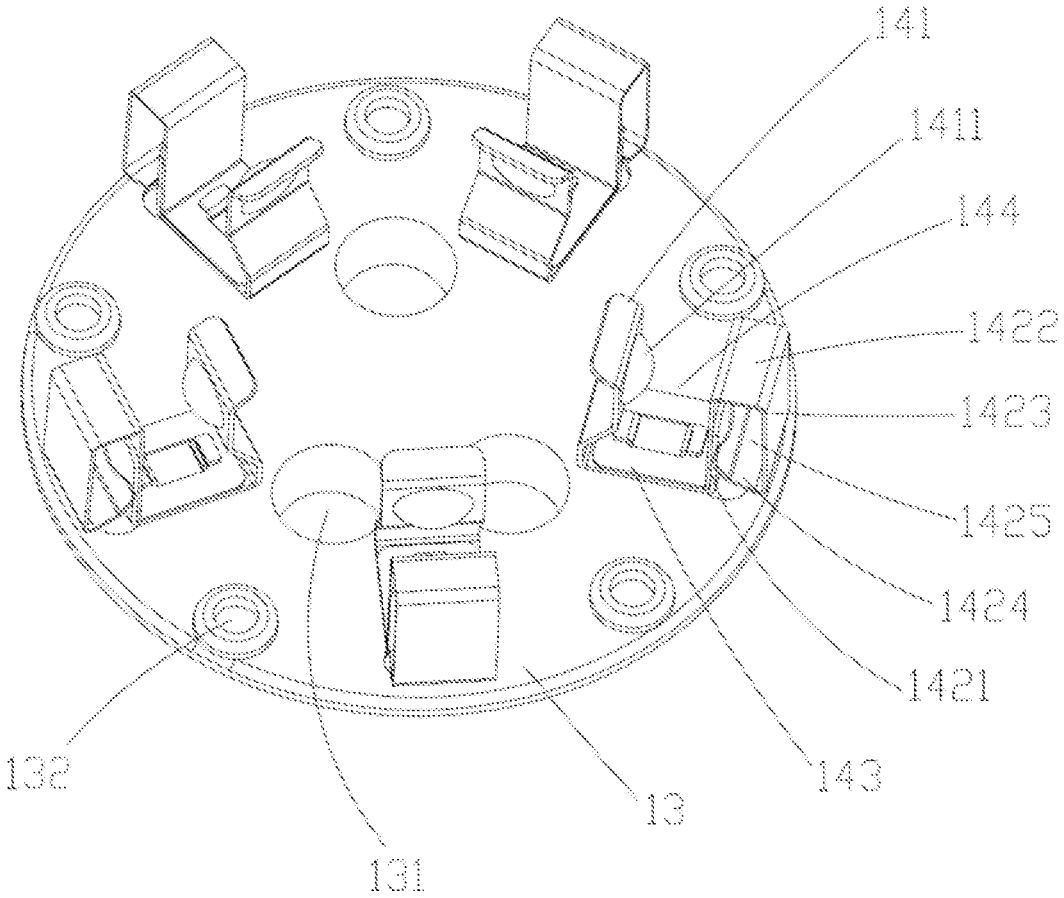
FIG. 5 is a stereo diagram of the installation bottom base shown in FIG. 4.

As shown in FIG. 4 and FIG. 5, the fixed installation structure 13 is plate-like and is embodied in a form of an installation end surface. The installation bottom base 10 is installed to a preset region, such as a ceiling, a wall, or the like by the fixed installation structure 13, and the lighting device 100 can even be installed in a lamp body of, for example, a desk lamp, a flower lamp, a decorative lamp or a pendant lamp as a detachable assembly. In one or more examples, the fixed installation structure 13 is detachably fixed in the preset region to adjust a position of the installation bottom base 10.

In an embodiment of the present disclosure, the fixed installation structure 13 is provided with a locking screw hole 131, and the fixed installation structure 13 is installed to the preset region by a screw (not shown in the figure) matching with the locking screw hole 131.

The installation bottom base 10 further comprises a bottom base terminal assembly (no labeled), and the bottom base terminal assembly comprises at least two bottom base terminals 14 exposed to the light source installation structure 12, so that when the light source module is installed to the light source installation structure 12, the light source module can be electrically connected with the bottom base terminals 14. In one or more examples, the bottom base terminals 14 can be arranged in the matching inner cavity 111, to allow the bottom base terminals 14 to be exposed to the light source installation structure 12.

In one or more examples, the bottom base terminals 14 are installed to the fixed installation structure 13 and extend into the matching inner cavity 111. The matching inner cavity 111 is arranged annularly, the bottom base terminals 14 are arranged on a same circumference at an equal distance or an equal angle, and the circumference on which the bottom base terminals 14 are provided is the circular ring formed by the matching inner cavity 111. Of course, the bottom base terminals 14 can also be arranged at any distance or any angle.

Each of the bottom base terminals 14 comprises a first terminal portion 141 and a second terminal portion 142 opposite to each other. The first terminal portion 141 and the second terminal portion 142 can be formed by bending a metal conductive strip, and both the first terminal portion 141 and the second terminal portion 142 have a given elasticity.

In one or more examples, the first terminal portion 141 and the second terminal portion 142 are connected by a middle portion 143 provided between the first terminal portion 141 and the second terminal portion 142. The first terminal portion 141, the second terminal portion 142 and the middle portion 143 cooperate to form a terminal clamping cavity 144 with an open at one end thereof. In one or more examples, the open of the terminal clamping cavity 144 faces the preset insertion direction D.

In an embodiment of the present disclosure, the first terminal portion 141 is approximately plate-like, and the first terminal portion 141 is provided with a matching convex portion 1411 protruding towards the terminal clamping cavity 144. The second terminal portion 142 comprises a first portion 1421 basically parallel to the first terminal portion 141, the first portion 1421 is connected with the middle portion 143, and a size of the first portion 1421 is basically equal to a size of the first terminal portion 141. In one or more examples, the terminal clamping cavity 144 is formed between the first terminal portion 141 and the first portion 1421.

The second terminal portion 142 further comprises a second portion 1422, one end of the second portion 1422 is connected with the first portion 1421, the second portion 1422 has an angle with the first portion 1421, and the angle can be about 90 degrees. The other end of the second portion 1422 is connected with one end of a third portion 1423, and the third portion 1423 is basically parallel to the first portion 1421; a fourth portion 1424 is formed at the other end of the third portion 1423, and the fourth portion 1424 tilts towards the second portion 1422 and contacts the first portion 1421.

The first portion 1421, the second portion 1422, the third portion 1423 and the fourth portion 1424 cooperate to form a closed wire receiving region 1425. Wires can extend into the wire receiving region 1425 and be electrically connected with any one of the first portion 1421, the second portion 1422, the third portion 1423 and the fourth portion 1424. Preferably, the wires can be arranged between the fourth portion 1424 and the first portion 1421.

In one or more examples, in a case where the power module adopts commercial power of 220V, a minimum distance between the bottom base terminals 14 and a surface, which can be touched by a hand of a person, of the installation bottom base 10 is more than 4.8 millimeters so as to ensure that the bottom base terminals have a reasonable electrical clearance and prevent a risk of electric shock when a user holds the bottom base terminals; a distance between adjacent bottom base terminals is more than 2.5 millimeters so as to ensure a reasonable creepage distance between two adjacent bottom base terminals 14 and prevent a potential safety risk of the installation bottom base 10.

In an embodiment of the present disclosure, the first terminal portion 141 is exposed to the matching inner cavity 111, the main body 11 further comprises a clamping groove 116 (see FIG. 11 for details), the clamping groove 116 is arranged around the matching inner cavity 111, and the second terminal portion 142 of each of the bottom base terminals 14 is clamped in the clamping groove 116, so that a terminal matched and connected with the bottom base terminals is only electrically connected with the first terminal portion 141.

In one or more examples, by using the elasticity of the metal conductive strip, an elastic connection between the first terminal portion 141 and the second terminal portion 142 is realized, to allow a size of the terminal clamping cavity 144 to have a given elastic or changeable range.

In an embodiment of the present disclosure, a number of the bottom base terminals 14 is same as a number of the fool-proof notch 114, and each of the bottom base terminals 14 is in an extending direction of any fool-proof notch 114, that is, the bottom base terminals 14 are paired to the fool-proof notches 114 one by one, and a line connecting any pair of the bottom base terminal 14 and the fool-proof notch 114 is along the preset insertion direction D.

In an embodiment of the present disclosure, the fixed installation structure 13 is provided with wire through holes 132, and the wire through holes 132 extend into the clamping groove(s) 116, so that the wires are electrically connected with the second terminal portion 142 in the clamping groove(s) 116 via the wire through holes 132. Specifically, the wires extend into the terminal clamping cavity 144 and are electrically connected with any one of the first portion 1421, the second portion 1422, the third portion 1423 and the fourth portion 1424. It should be explained herein that the wires are eventually clamped in a structure corresponding to the second terminal portion 142.

A number of the wire through holes 132 can be at least two so that at least two wires are electrically connected with the second terminal portion 142 respectively via the at least two wire through holes 132.

In one or more examples, a number of the wire through holes 132 can be the same as or different from a number of the bottom base terminals 14, the number of the wire through holes 132 is determined according to the number of the bottom base terminals 14 which need to be connected. In a case where the number of the wire through holes 132 is the same as the number of the bottom base terminals 14, the wire through holes 132 and the bottom base terminals 14 are arranged alternately to reduce a length of the wires that required to be provided through the wire through holes 132 to the bottom base terminals 14.

It should be noted that a number of output wires of the power module is same as the number of the wire through holes 132, in a case where the number of the wire through holes 132 is five, the number of an output wires of the power module is also five. The five output wires comprise one positive output wire and four negative output wires, and the negative output wires are connected to each other in parallel.

The positive output wire of the power module can be electrically connected with some one of the bottom base terminals 14 via the wire through holes 132, the negative output wires are electrically connected with other bottom base terminals 14 via the wire through holes 132, and for example, two of the negative output wires are respectively connected with one of the bottom base terminals 14.

Of course, the number of output wires of the power module cannot be more than the number of the bottom base terminals 14, for example, the number of the bottom base terminals 14 is five, then the number of output wires of the power module is not more than five, in this case, the output wires of the power module comprise one positive output wire and four negative output wires, and the negative output wires are also connected to each other in parallel.

By providing a plurality of bottom base terminals 14 and arranging a plurality of output wires of the power module, the bottom base terminals 14 can form a plurality independent power supply circuits. In this way, when the bottom base terminals 14 are electrically connected with the light emitting units of the light source module, the at least two light emitting units are in different power supply circuits, and current values supplied to the light emitting units can be adjusted according to different adjustment ranges so that a color or illumination of light emitted by the light emitting units is quickly adjusted.

Figure 6:
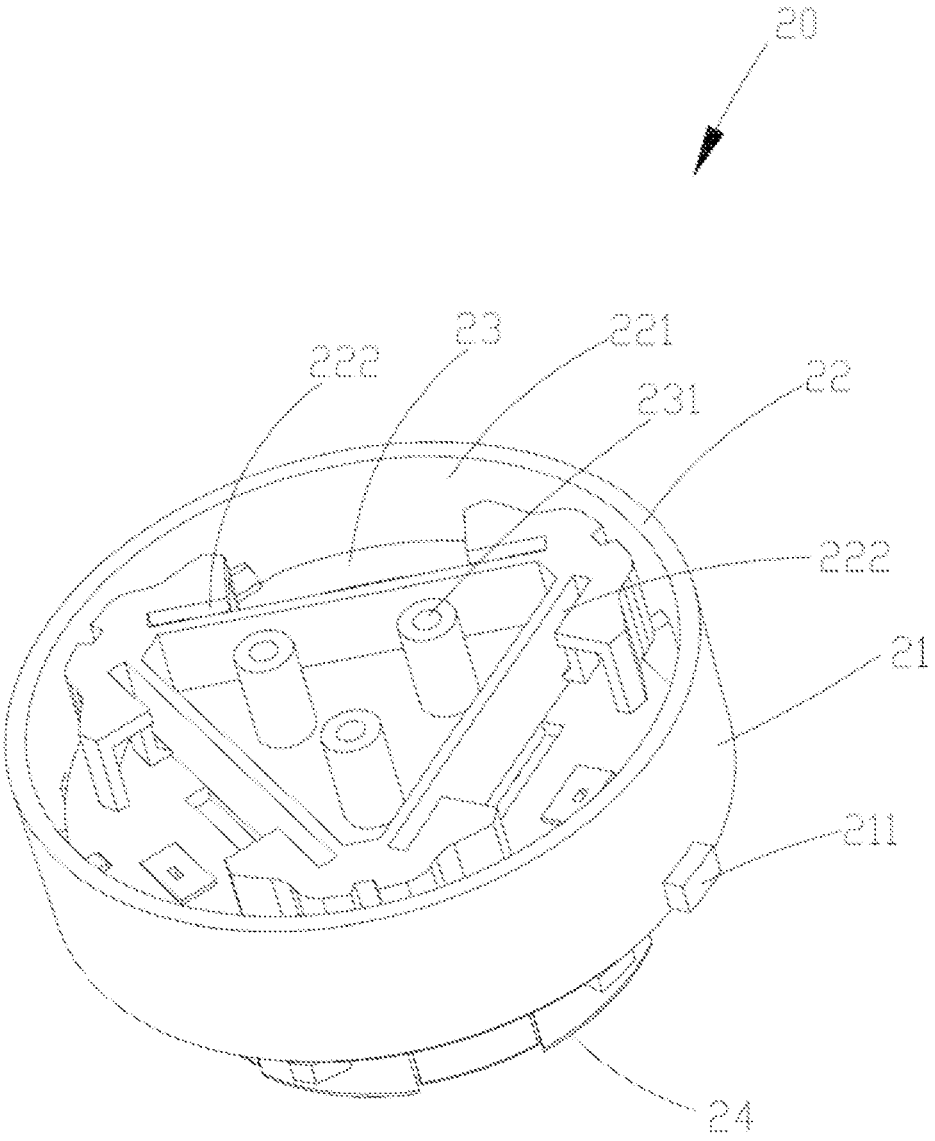
FIG. 6 is a stereo diagram of a connection base in the lighting device shown in FIG. 1.

As shown in FIG. 6, the connection base 20 comprises a base portion 21, an assembly installation structure 22 and a base terminal assembly (no labeled).

A shape of the base portion 21 can be determined according to an overall shape of the lighting device 100 or an illumination environment, for example, a barrel-like shape; the base portion 21 can be made of insulating materials, such as hard plastics, to ensure a structural stability and safety of the connection base 20.

In an embodiment of the present disclosure, a periphery of the base portion 21 is provided with a guide boss 211, and the guide boss 211 extends outwardly away from the surface of the base portion 21.

The assembly installation structure 22 is connected with the base portion 21 and used for installing the light emitting assembly 30, the assembly installation structure 22 can adopt a form of an insertion interface, and specifically, the assembly installation structure 22 adopts a form of a female connector. In this case, the assembly installation structure 22 forms a assembly receiving cavity 221, and the light emitting assembly 30 is detachably installed into the assembly receiving cavity 221.

In one or more examples, the assembly installation structure 22 and the base portion 21 can be prepared by integral moulding of plastics to improve the integrity of the connection base 20.

In one or more examples, the light emitting assembly 30 further comprises a light source plate supporting the light emitting units, and the assembly installation structure 22 further comprises plate slots 222 in the assembly receiving cavity 221. By inserting the light source plate in the plate slots 222, the light source plate is installed to the assembly installation structure 22.

In an embodiment of the present disclosure, a number of the plate slots 222 is at least two, and the plate slots 222 are in an end-to-end connection and are arranged annularly. For example, in a case where three plate slots 222 are provided, the plate slots 222 are arranged into a triangle. Of course, in other embodiments of the present disclosure, as the number of the plate slots 222 varies, the arrangement mode of slots 222 varies. For example, in a case where two plate slots 222 are provided, the two plate slots 222 are arranged parallel to each other.

The connection base 20 further comprises a control circuit board 23 in the assembly receiving cavity 221 and electrically connected with the plate slots 222, and the control circuit board 23 is also electrically connected with the base terminal assembly. The control circuit board 23 can be understood as a common printed circuit board, on which corresponding functional components, such as microcontroller (MCU), are printed according to requirements.

In one or more examples, the control circuit board 23 is provided with a plate screw hole 231, and the control circuit board 23 is fastened to the base portion 21 by the matching of a screw (not shown in the figure) and the plate screw hole 231.

In one or more examples, a communication between the control circuit board 23 and the preset terminal (not shown) can be established by a wireless communication or wired communication, so as to obtain relevant control instructions through the preset terminal and the control circuit board 23 controls the light emitting units on the light source plate in the plate slots 222 according to the control instructions. The preset terminal can be a button, a knob or a control panel in a wired connection with the control circuit board 23. The button, the knob or the control panel can be directly arranged on a housing of the lighting device. The preset terminal can also be a smartphone, a tablet computer, a remote controller, or the like wirelessly connected with the control circuit board 23.

Figure 7:
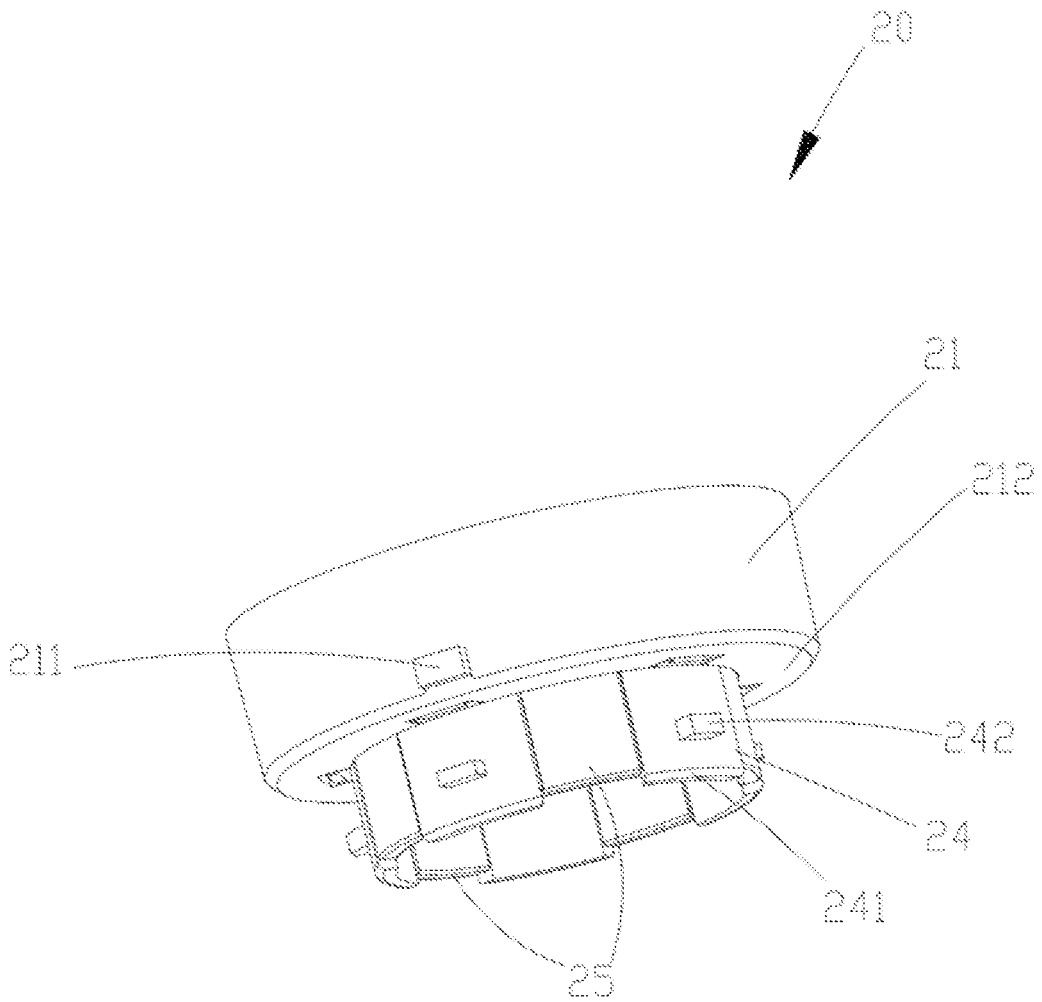
FIG. 7 is a stereo diagram at another angle of the connection base shown in FIG. 6.

As shown in FIG. 7, the connection base 20 comprises a bottom base installation structure 24, and the bottom base installation structure 24 is used for installing to the installation bottom base 10, so that the installation bottom base 10 is matched and connected with the connection base 20. The bottom base installation structure 24 and the assembly installation structure 22 are arranged on two sides opposite to each other of the base portion 21 to avoid an interference between the installation bottom base 10 installed to the bottom base installation structure 24 and the assembly installation structure 22 and the light emitting units 30.

The bottom base installation structure 24 extends from the base portion 21 along the preset insertion direction D, a width of the bottom base installation structure 24 is less than a width of the base portion 21, that is, along the preset insertion direction D, a cross-section size of the bottom base installation structure 24 is less than that of the base portion 21. In one or more examples, a thickness of the bottom base installation structure 24 is basically equal to or less than that of the matching inner cavity 111, so that the bottom base installation structure 24 can smoothly enter and be separated from the matching inner cavity 111.

In an embodiment of the present disclosure, the base portion 21 is approximately cylindrical, and the bottom base installation structure 24 is approximately in a shape of a circular ring. The base portion 21 comprises a bottom surface 212. The bottom base installation structure 24 is basically located in a middle region of the bottom surface 212.

Figure 8:
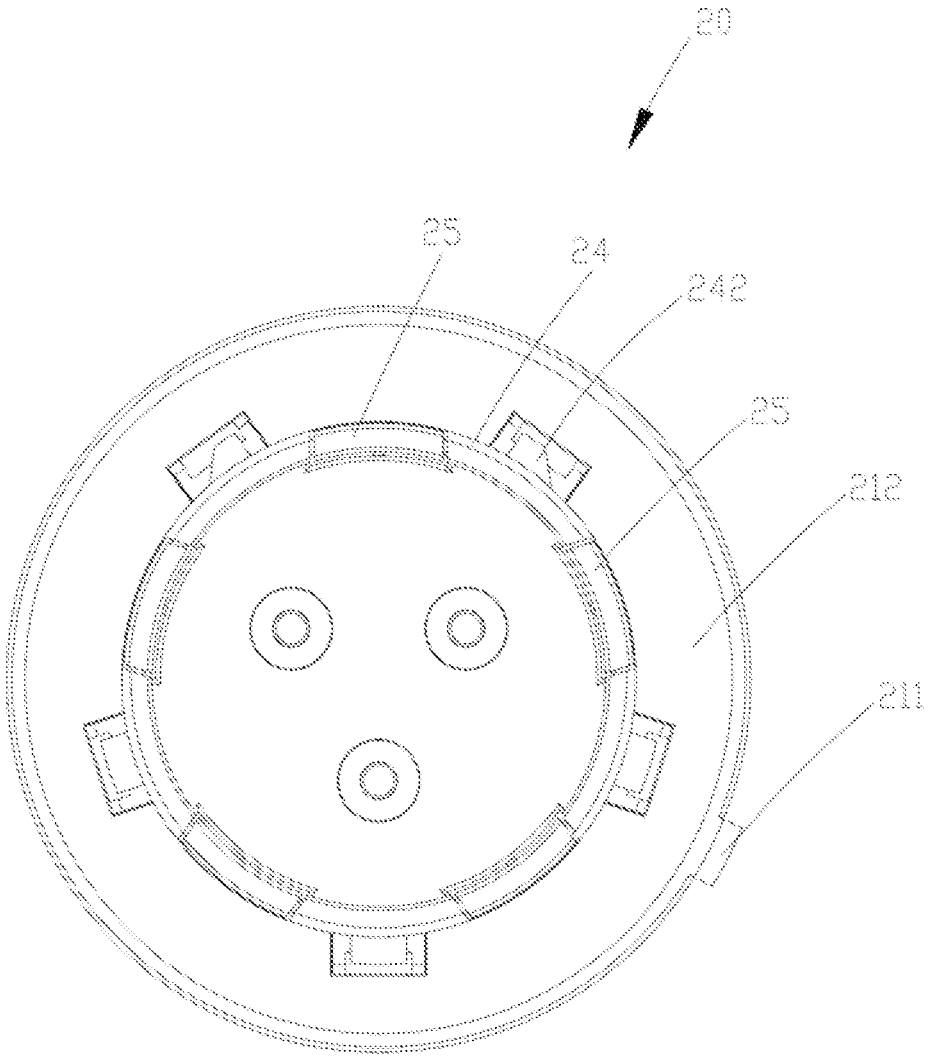
FIG. 8 is a bottom view of the connection base shown in FIG. 6.

As shown in FIG. 8, the base terminal assembly comprises at least two base terminals 25, and the base terminals 25 are exposed to the assembly installation structure 22 and extend to the bottom base installation structure 24. Specifically, the base terminals 25 are arranged on the bottom base installation structure 24 at an equal distance or an equal angle, and the bottom base installation structure 24 comprises a matching end 241, and the base terminals 25 extend to the matching end 241 and cover a portion of the matching end 241. Each of the base terminals 25 comprises two portions (no labeled) opposite to each other and clamped on two sides of the matching end(s) 241.

Of course, an arrangement mode of the base terminals 25 can be adjusted according to the bottom base terminals 14. For example, in a case where the bottom base terminals 14 are not arranged at an equal distance, the base terminals 25 are not arranged at an equal distance, either.

In an embodiment of the present disclosure, the bottom base installation structure 24 further comprises a fool-proof boss 242 between adjacent base terminals, and the fool-proof boss 242 extends along a direction perpendicular to the preset insertion direction D and away from the bottom base installation structure 24.

In one or more examples, a number of the fool-proof boss 242 is same as a number of the base terminals 25, and the fool-proof boss 242 and the base terminals 25 are arranged alternately.

Figure 9:
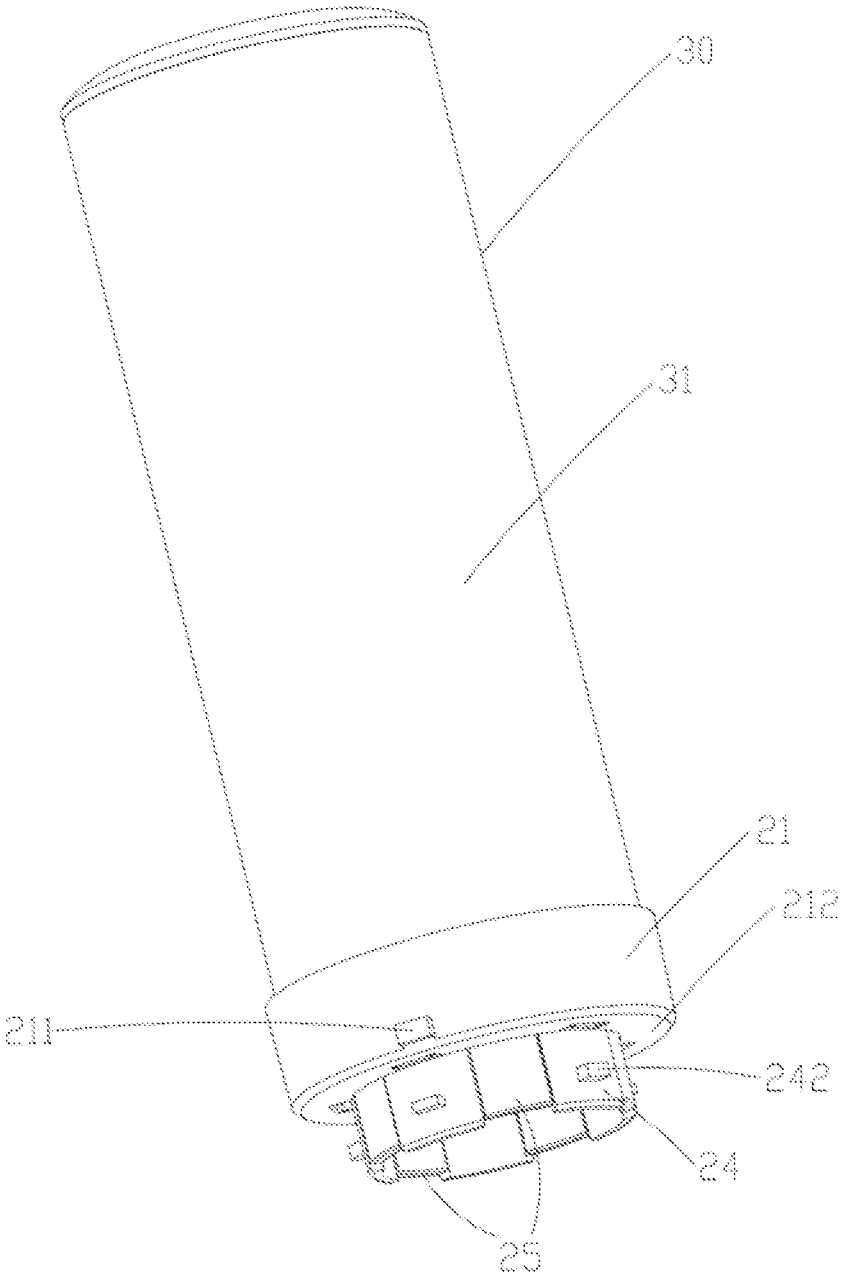
FIG. 9 is a stereo diagram of a light source module in the lighting device shown in FIG. 1.

As shown in FIG. 9, after the light emitting assembly 30 is installed to the connection base 20, the light source module for independent use can be obtained.

The light emitting assembly 30 comprises an optical element 31 and a shape of an end of the optical element 31 matches with the connection base 20, and the optical element 31 is used to protect the light emitting units from external collisions and realize a projection of illumination light emitted by the light emitting units onto an object. The optical element 31 can be in a form of a lens that can be directly passed through by the illumination light emitted by the light emitting units, or in a form of a light-mixing hood that can uniformly adjust the illumination light emitted by the light emitting units. Whether in the form of the lens or the light-mixing hood, a shape of the optical element 31 can be preset according to the illumination environment or a shape of the connection base 20, for example, the shape of the optical element 31 can be cylindrical and a size of the optical element 31 matches with the connection base 20.

Figure 10:
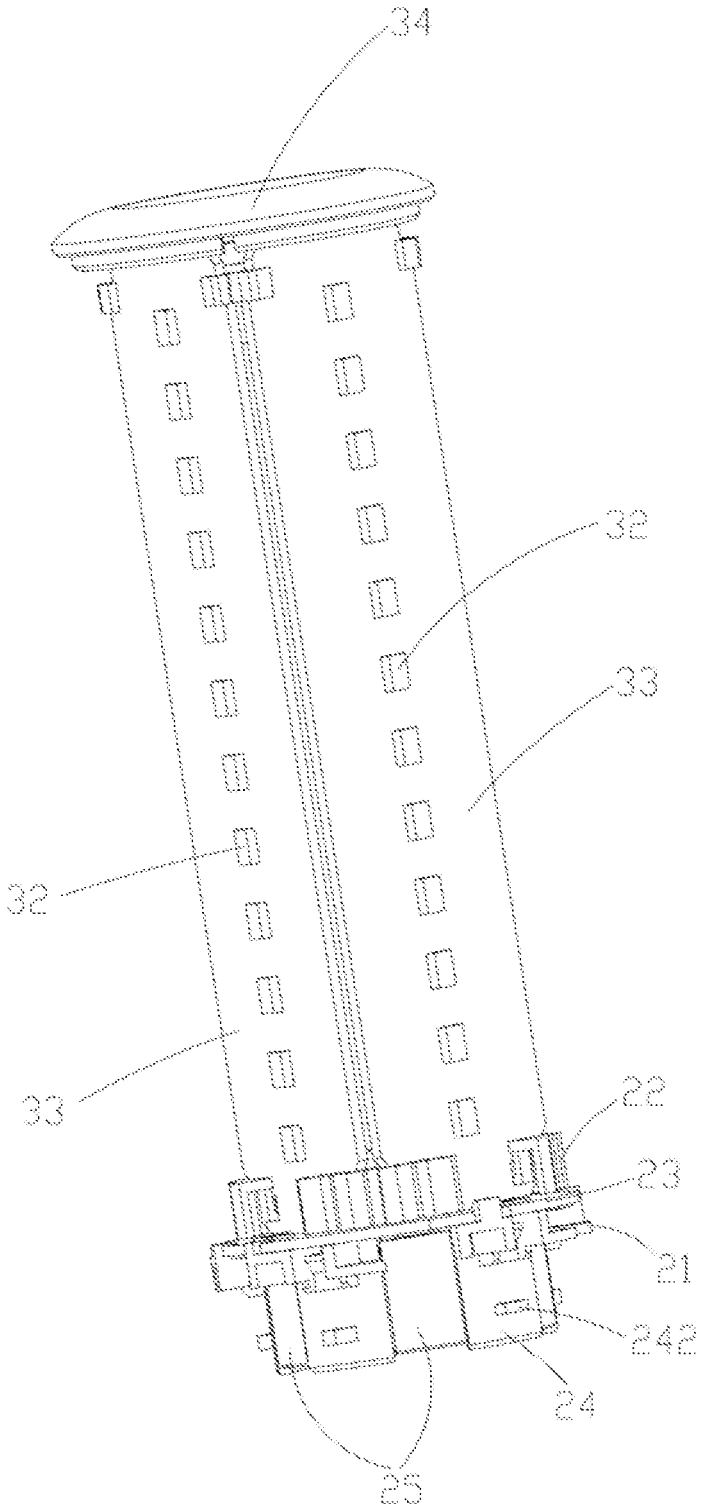
FIG. 10 is a stereo diagram of the light source module shown in FIG. 9, in which both the optical element in the light emitting assembly in the light source module and the body of the connection base are hidden.

As shown in FIG. 10, the light emitting assembly 30 further includes light emitting units 32 covered by the optical element 31. A number of the light emitting units 32 can be preset according to lighting requirements. A type of the light emitting units 32 can be an LED light source, a TL light source, or the like.

In an embodiment of the present disclosure, the light emitting assembly 30 further comprises a light source plate 33 supporting the light emitting units 32, and a number of the light source plate 33 can be more than one, a number of the light emitting units of each light source plate 33 can be same or different, and parameters, such as color, illumination, of the light emitting units of each light source plate 33 can be same or different.

In one or more examples, the light source plate 33 is inserted in the plate slots 222 of the assembly installation structure 22 (as shown in FIG. 6), and the plate slots 222 are electrically connected/coupled with the control circuit board 23, to allow all the light emitting units 32 of the light source plate 33 to be electrically connected with the control circuit board 23.

By controlling the control circuit board 23, the light source plate 33 can be electrically connected with the base terminals 25, and the number of the light source plate 33 is less than the number of the base terminals 25. In an embodiment of the present disclosure, the number of the light source plate 33 is three, the number of the base terminals 25 is five, by connecting the three light source plates 33 with different base terminals 25 to realize multiple connection modes, and the details are as follows:

A) taking LED light sources as the light emitting units 32, positive electrodes of the three light source plates 33 are connected/coupled to a same base terminal 25, and negative electrodes of the three light source plates 33 are respectively connected to one of the bottom base terminals, so that the three light source plates 33 are connected in parallel. By presetting the light colors of the light emitting units on each of the three light source plates 33, for example, the light colors of the light emitting units 32 on each of the three light source plates 33 are respectively red, green and blue, the control circuit board 23 obtains the control instructions sent by the preset terminal and adjusts current values supplied to the light emitting units 32 of each of the light source plates 33 according to the control instructions, and then a desired color is obtained by combining the red light, the green light and the blue light according to user needs.

B) taking LED light sources as the light emitting units 32, positive electrodes of all the light emitting units of the three light source plates 33 are connected to a same base terminal 25, and input terminals of RGBW components of all the light emitting units 32 of the three light source plates 33 are connected to a same base terminal 25 by the control circuit plate 23. The control instructions sent by the preset terminal are obtained by the control circuit board 23, a current value of the base terminal 25 connected with the RGBW components of the light emitting units are adjusted according to the control instructions, so that a desired color of light is obtained and the light colors of all the light emitting units 32 are adjusted at a same time.

C) taking LED light sources as the light emitting units 32, positive electrodes of all the light emitting units of the three light source plates 33 are connected to a same base terminal 25, and pins of RGB components of all the light emitting units 32 of the three light source plates 33 are connected to a same base terminal 25. The control instructions sent by the preset terminal are obtained by the control circuit board 23, a current value of the base terminal 25 connected with the RGB components of the light emitting units are adjusted according to the control instructions, so that a desired color of light is obtained and the light colors of all the light emitting units 32 are adjusted at a same time.

D) taking LED light sources as the light emitting units 32, positive electrodes of the three light source plates 33 are connected to a same base terminal 25, and negative electrodes of the three light source plates 33 are connected to a same bottom base terminal, so that the three light source plates 33 are connected in parallel. The control instructions sent by the preset terminal are obtained by the control circuit board 23, current values of only the two base terminals 25 are adjusted according to the control instructions, the illumination of the light emitted by the lighting device 100 can be adjusted.

In summary, because at least two base terminals 25 are provided, the at least two light emitting units 32 of the light emitting assembly are in different power supply circuits, so that the current values supplied to the light emitting units 32 can be adjusted according to different adjustment amplitudes so that the color or illumination of the light emitted by the light emitting units is quickly adjusted.

Subsequently, after the light source plates 33 are inserted into the plate slots 222, a position of an upper portion of each of the light source plates 33 is further limited by a connection member 34 which can be made of plastic or other materials. The connection member 34 is relatively fixed with the optical element 31, so that each of the light source plates 33 is relatively stable.

Figure 11:
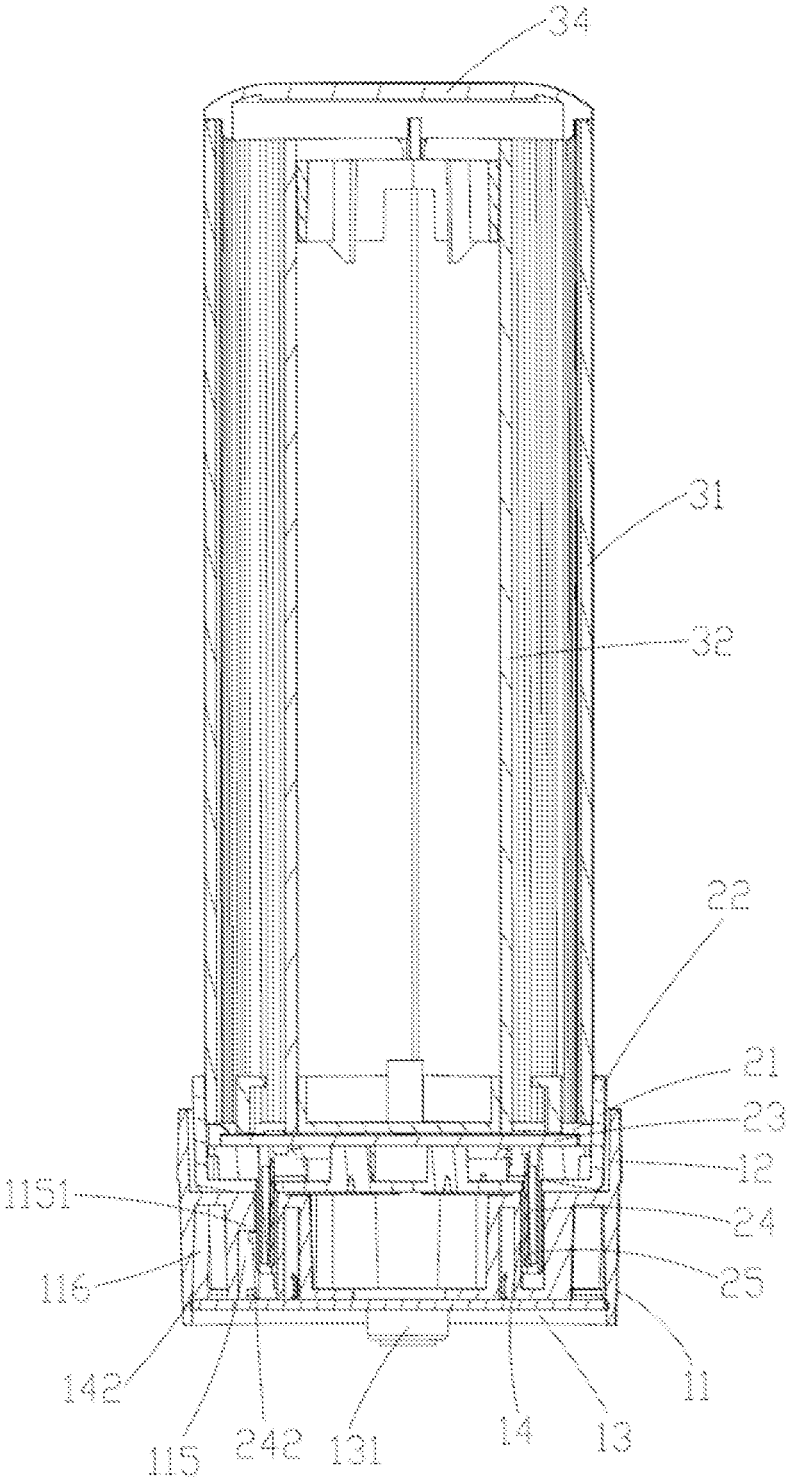
FIG. 11 is a cross-section view of the lighting device shown in FIG. 1 along a direction A-A.
Figure 12:
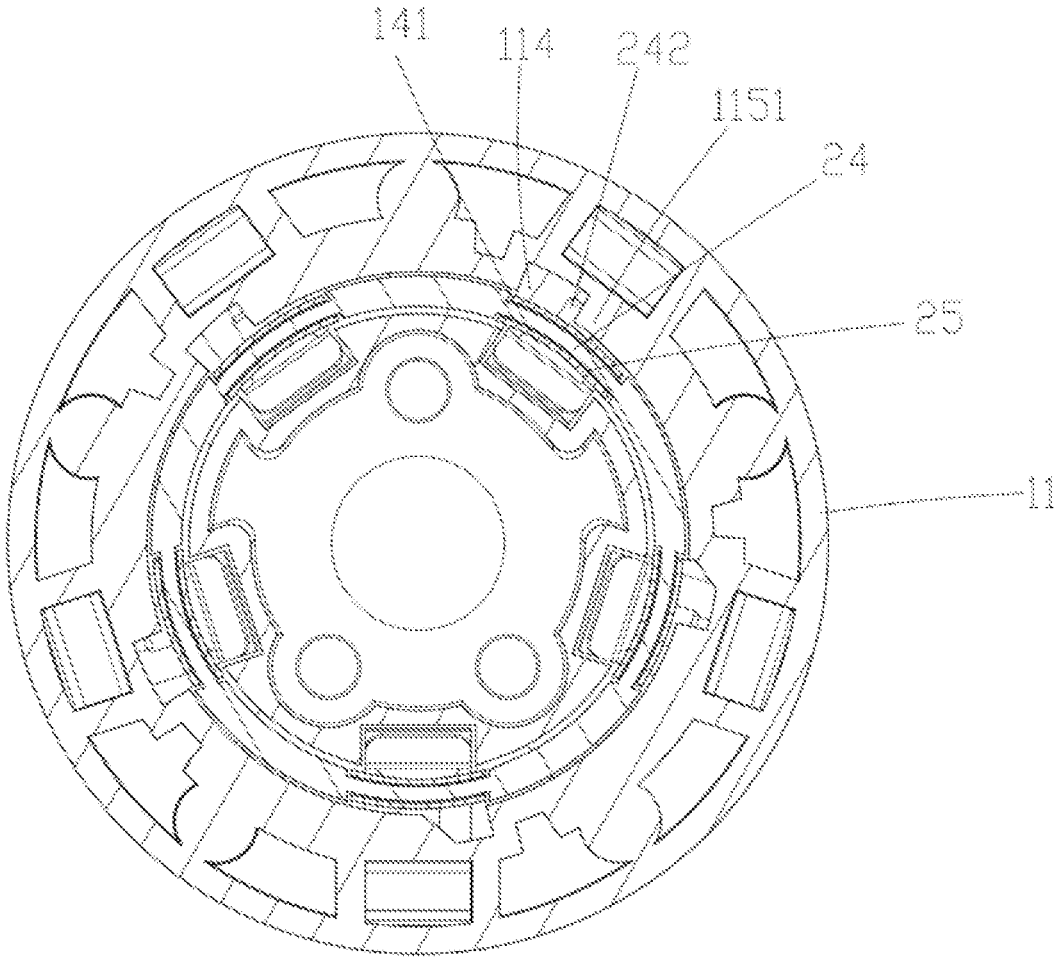
FIG. 12 is a cross-section view of the lighting device shown in FIG. 1 along a direction B-B.

Referring to FIG. 11 and FIG. 12, a connection relationship, and an assembling manner of the installation bottom base 10, the connection base 20 and the light emitting assembly 30 in the lighting device 100 and the lighting principle of the lighting device 100 are described in detail in the following.

The connection base 20 is used to connect the light emitting assembly 30 and the installation bottom base 10. In this way, after the installation bottom base 10 obtains electrical power from the power module, the obtained electrical power is transmitted to the light emitting assembly 30, so that the lighting device 100 is lightened.

The connection base 20 enters the light source installation structure 12 of the installation bottom base 10 along the present insertion direction D by the bottom base installation structure 24, at this time, it is required that the guide boss 211 in the periphery of the base portion 21 is adjusted to align with the guide notch 1211 in the light source installation structure 12 and drive the bottom base installation structure 24 to move towards the light source installation structure 12 along the guide notch 1211.

When the bottom base installation structure 24 moves towards the light source installation structure 12, the bottom base installation structure 24 successively passes through the matching external cavity 122 and enters the matching inner cavity 111. At this time, it is required that the fool-proof boss 242 of the bottom base installation structure 24 is aligned with the fool-proof notch 114 and drive the bottom base installation structure 24 along the fool-proof notch 114 to deeply enter the matching inner cavity 111.

When the bottom surface 212 of the connection base 20 is supported by the blocking wall 112 of the installation bottom base 10, the bottom base installation structure 24 cannot deeply enter the matching inner cavity 111. At this time, the fool-proof boss 242 is separated from the fool-proof notch 114, and then the connection base 20 is rotated along a direction of moving the guide boss 211 towards the clamping notch 1212, meanwhile, the fool-proof boss 242 is driven to enter the position limiting groove 115 communicated with the fool-proof notch 114. The fool-proof boss 242 is limited by the groove wall 1151 of the position limiting groove 115, and the guide boss 211 is limited by the matching outer wall 121 outside the clamping notch 1212, so that the connection base 20 is tightly connected with the installation bottom base 10.

After the guide boss 211 is rotated towards the clamping notch 1212, as the first terminal portion 141 is elastically connected with the second terminal portion 142, the base terminals 25 can extrude and remove the first terminal portion 141 and then enter the terminal clamping cavity 144 and be electrically connected with the reset first terminal portion 141.

For example, for the installation bottom base 10 adopting five bottom base terminals 14 and the five bottom base terminals 14 being respectively connected with one positive output wire and four negative output wires of the power module, and the connection base 20 adopting five base terminals and the five base terminals 25 being respectively connected with the pins of the RGBW components of the light emitting units 32 and a common positive electrode, the base terminals 25 and the bottom base terminals 14 are connected one by one under a restriction of the fool-proof boss 242, and the electrical power sent by the power module enters the input terminal of the RGBW components by successively passing through the bottom base terminals 14 and the base terminals 25.

Subsequently, a micro-controller in the control circuit plate 23 can adjust currents of the four negative output wires of the power module according to a preset control program logic, so as to control the RGBW components of the light emitting units 32 and realize an adjustment of the color of the light emitted by the lighting device 100.

It can be seen from the technical solutions of the embodiments of the present disclosure, in the installation bottom base, the connection base, the light source module and the lighting device provided by the embodiments of the present disclosure, currents supplied to the light emitting units by the power module is transmitted by the at least two terminals, so that the illumination of the light emitting units is adjusted. Especially, the currents supplied to the light emitting units by the power module can be transmitted by three or more than three terminals, so that at least two light emitting units are in different power supply circuits, the current values supplied to the light emitting units can be adjusted according to different adjustment amplitudes, and a color or illumination of light emitted by the light emitting units can be quickly adjusted.

Moreover, by a cooperation of the light source installation structure 12 in a shape of a circular ring or the assembly installation structure 22 and the terminals extending to the installation structures and arranged on the same circumference, so that when the installation bottom base is coupled with the connection base, it is not required to align the terminals, the light source installation structure and the bottom base installation structure can be coupled at any angle. The terminals can be aligned by rotating the light source installation structure or the bottom base installation structure subsequently, so that an assembling efficiency of the lighting device is improved.

Preferably, the light source installation structure comprises a matching outer wall arranged annularly and connected with the main body, and a matching outer cavity formed by the matching outer wall; the light source module is inserted into the matching outer cavity along a preset insertion direction and is detachably locked with the matching outer wall.

Preferably, the matching outer wall is provided with a guide notch extending along the preset insertion direction and a clamping notch communicated with the guide notch, and the clamping notch extends from the guide notch along a circumferential direction of the matching outer wall.

Preferably, the main body comprises a matching inner cavity communicated with the matching outer cavity, the matching inner cavity has a width less than that of the matching outer cavity, and the bottom base terminals are in the matching inner cavity.

Preferably, the matching inner cavity is arranged in a shape of a circular ring.

Preferably, the at least two bottom base terminals are in the matching inner cavity and are arranged on a same circumference at an equal angle.

Preferably, the main body comprises a matching inner wall formed on an outer surface of the matching inner cavity, a fool-proof notch on the matching inner wall and extending along the preset insertion direction and a position limiting groove communicated with the fool-proof notch, the position limiting groove extending from the fool-proof notch along a circumferential direction of the matching inner wall.

Preferably, a number of the fool-proof notches is same as that of the bottom base terminals.

Preferably, each of the bottom base terminals is on an extension direction of any fool-proof notch.

Preferably, each of the bottom base terminals comprises a first terminal portion and a second terminal portion opposite to each other; and a terminal clamping cavity is formed between the first terminal portion and the second terminal portion.

Preferably, the first terminal portion is elastically connected with the second terminal portion.

Preferably, the second terminal portion comprises a first portion, a second portion and a third portion, the first portion being connected with the first terminal portion, the second portion connecting the first portion and the third portion, and the first portion, the second portion and the third portion cooperating to form a wire receiving region for connecting wires.

Preferably, the main body comprises a clamping groove arranged around the matching inner cavity, and the second terminal portion is clamped in the clamping groove.

Preferably, the fixed installation structure is provided with at least two wire through holes, each of the at least two wire through holes extending into the clamping groove.

Preferably, a number of the wire through holes is same as that of the bottom base terminals.

Preferably, the wire through holes and the bottom base terminals are arranged alternately.

To solve above technical problems, embodiments of the present disclosure provide a connection base for installing a light emitting assembly in a light source module. The light emitting assembly comprises a plurality of light emitting units. The connection base comprises: a base portion; an assembly installation structure connected with the base portion and used for installing the light emitting assembly; and a base terminal assembly comprising at least two base terminals extending to the assembly installation structure. When the light emitting assembly is installed to the connection base, the at least two base terminals are electrically connected with the plurality of light emitting units in the light emitting assembly, to allow at least two of the light emitting units in the light emitting assembly to be in different power supply circuits.

Preferably, a periphery of the base portion is provided with a guide boss.

Preferably, the light emitting assembly comprises a light source plate supporting the light emitting units, and the assembly installation structure comprises at least two plate slots for receiving the light source plate.

Preferably, the connection base comprises a control circuit board connecting the plate slots, the control circuit board being electrically connected with the base terminal assembly and being received in the base portion.

Preferably, the connection base comprises a bottom base installation structure for installing the installation bottom base, and the base terminals extend to the bottom base installation structure.

Preferably, the bottom base installation structure has a width less than that of the base portion.

Preferably, the bottom base installation structure is in a shape of a ring, and the at least two base terminals are arranged on the bottom base installation structure and are arranged on a same circumference at an equal angle.

Preferably, the bottom base installation structure comprises a matching end, and the base terminals extend to the matching end.

Preferably, each of the base terminals comprises two portions opposite to each other and clamped on two sides of the matching end.

Preferably, the bottom base installation structure comprises a fool-proof boss between adjacent base terminals.

Preferably, a number of the fool-proof bosses is same as that of the base terminals.

To solve above technical problems, embodiments of the present disclosure provide a light source module, characterized in that it comprises the connection base according to above disclosure content; and the light emitting assembly comprising the plurality of light emitting units installed to the connection base and electrically connected with the base terminals. The base terminals cooperate with the light emitting units to allow at least two of the light emitting units to be in different power supply circuits.

To solve the above technical problems, embodiments of the present disclosure provide a lighting device, characterized in that it comprises the installation bottom base according to above disclosure content; the connection base according to above disclosure content and installed to the installation bottom base, the base terminals being electrically connected with the bottom base terminals; and the light emitting assembly comprising the plurality of light emitting units installed to the connection base and electrically connected with the base terminals. The base terminals cooperate with the bottom base terminals to allow at least two of the light emitting units to be in different power supply circuits.

Preferably, the lighting device comprises a power module, and the power module comprises output wires connecting the base terminals, and the output wires comprise a positive output wire and at least two negative output wires.

It can be seen from the technical scheme provided by the embodiments of the present disclosure that, in the installation bottom base, the connection base, the light source module and the lighting device provided by the embodiments of the present disclosure, currents supplied to the light emitting units by the power module are transmitted by the at least two terminals, so that the at least two light emitting units are in different power supply circuits, current values supplied to the light emitting units can be adjusted according to different adjustment amplitudes, and a color or illumination of light emitted by the light emitting units is quickly adjusted.

The embodiments in the description are described in a progressive manner, and the same and similar parts among the embodiments can be referred to each other. Each embodiment focuses on the differences from other embodiments. In particular, for embodiments about systems, because they are basically similar to embodiments about methods, the description about the embodiments about the systems is relatively simple, and the relevant points can be referred to the relevant part of the description of the embodiments about the methods.

The above description only relates to some embodiments of the present disclosure and is not intended to limit the present disclosure. For one of ordinary skill in the art, the present disclosure may have various modifications and changes. Any modification, equivalent replacement, improvement, or the like, made within the spirit and principle of the disclosure shall be fall in the scope of the claims of the disclosure.

What is claimed is:

1. An installation bottom base for installing a light source module in a lighting device, the light source module comprising a plurality of light emitting units, and the installation bottom base comprising:

a main body;

a fixed installation structure connected with the main body and used for installing the installation bottom base to a preset region;

a light source installation structure connected with the main body and used for installing the light source module, wherein the light source installation structure comprises a matching outer wall arranged annularly and connected with the main body, the matching outer wall is provided with a guide notch extending along a preset insertion direction and a clamping notch communicated with the guide notch, and the clamping notch extends from the guide notch along a circumferential direction of the matching outer wall; and a bottom base terminal assembly comprising at least two bottom base terminals exposed to the light source installation structure; when the light source module is installed to the installation bottom base, the at least two bottom base terminals are electrically connected with the plurality of light emitting units in the light source module, to allow at least two of the light emitting units in the light source module to be in different power supply circuits.

2. The installation bottom base according to claim 1, wherein the light source installation structure comprises a matching outer cavity formed by the matching outer wall; the light source module is inserted into the matching outer cavity along the preset insertion direction and is detachably locked with the matching outer wall.

3. The installation bottom base according to claim 2, wherein the main body comprises a matching inner cavity communicated with the matching outer cavity, the matching inner cavity has a width less than that of the matching outer cavity, and the bottom base terminals are in the matching inner cavity.

4. The installation bottom base according to claim 3, wherein the matching inner cavity is arranged in a shape of a circular ring.

5. The installation bottom base according to claim 4, wherein the at least two bottom base terminals are in the matching inner cavity and are arranged on a same circumference at an equal angle.

6. The installation bottom base according to claim 3, wherein the main body comprises a matching inner wall formed on an outer surface of the matching inner cavity, a fool-proof notch on the matching inner wall and extending along the preset insertion direction and a position limiting groove communicated with the fool-proof notch, the position limiting groove extending from the fool-proof notch along a circumferential direction of the matching inner wall.

7. The installation bottom base according to claim 3, wherein each of the bottom base terminals comprises a first terminal portion and a second terminal portion opposite to each other; and a terminal clamping cavity is formed between the first terminal portion and the second terminal portion.

8. The installation bottom base according to claim 7, wherein the first terminal portion is elastically connected with the second terminal portion.

9. The installation bottom base according to claim 7, wherein the second terminal portion comprises a first portion, a second portion and a third portion, the first portion being connected with the first terminal portion, the second portion connecting the first portion and the third portion, and the first portion, the second portion and the third portion cooperating to form a wire receiving region for connecting wires.

10. The installation bottom base according to claim 7, wherein the main body comprises a clamping groove arranged around the matching inner cavity, and the second terminal portion is clamped in the clamping groove.

11. The installation bottom base according to claim 10, wherein the fixed installation structure is provided with at least two wire through holes, each of the at least two wire through holes extending into the clamping groove.

12. The installation bottom base according to claim 11, wherein a number of the wire through holes is same as that of the bottom base terminals.

13. The installation bottom base according to claim 12, wherein the wire through holes and the bottom base terminals are arranged alternately.

14. A connection base used for installing a light emitting assembly in a light source module, the light emitting assembly comprising a plurality of light emitting units, wherein the connection base comprises:

a base portion;

an assembly installation structure connected with the base portion and used for installing the light emitting assembly, wherein the light emitting assembly comprises a light source plate supporting the light emitting units, and the assembly installation structure comprises at least two plate slots for receiving the light source plate;

a base terminal assembly comprising at least two base terminals extending to the assembly installation structure; when the light emitting assembly is installed to the connection base, the at least two base terminals are electrically connected with the plurality of light emitting units in the light emitting assembly, to allow at least two of the light emitting units in the light emitting assembly to be in different power supply circuits; and a control circuit board connecting the plate slots, the control circuit board being electrically connected with the base terminal assembly and being received in the base portion.

15. The connection base according to claim 14, wherein a periphery of the base portion is provided with a guide boss.

16. A lighting device, comprising:

an installation bottom comprising: a main body; a fixed installation structure connected with the main body and used for installing the installation bottom base to a preset region; a light source installation structure connected with the main body and used for installing a light source module; and a bottom base terminal assembly comprising at least two bottom base terminals exposed to the light source installation structure; when the light source module is installed to the installation bottom base, the at least two bottom base terminals are electrically connected with a plurality of light emitting units in the light source module, to allow at least two of the light emitting units in the light source module to be in different power supply circuits;

a connection base comprising: a base portion; an assembly installation structure connected with the base portion and used for installing a light emitting assembly; and a base terminal assembly comprising at least two base terminals extending to the assembly installation structure; when the light emitting assembly is installed to the connection base, the at least two base terminals are electrically connected with the plurality of light emitting units in the light emitting assembly, to allow at least two of the light emitting units in the light emitting assembly to be in different power supply circuits, wherein the base terminals are electrically connected with the bottom base terminals; and the light emitting assembly comprising the plurality of light emitting units installed to the connection base and electrically connected with the base terminals, wherein the base terminals cooperates with the bottom base terminals to allow at least two of the light emitting units to be in different power supply circuits.

17. The lighting device according to claim 16, wherein the lighting device comprises a power module, and the power module comprises output wires connecting the base terminals, and the output wires comprise a positive output wire and at least two negative output wires.

* * * * *